US005128670A

United States Patent [19]

Jackson et al.

[11] Patent Number: 5,128,670

[45] Date of Patent: Jul. 7, 1992

[54] ROADWAY ALERT APPARATUS

[76] Inventors: Leonard C. Jackson, 9761 Tamalpais Dr., Dallas, Tex. 75212; Carl D. Adams, 1239 Fulghum Rd., Hutchins, Tex. 75141

[21] Appl. No.: 640,609

[22] Filed: Jan. 14, 1991

[51] Int. Cl.[5] ..... G08G 1/095

[52] U.S. Cl. ..... 340/907; 340/942; 40/614

[58] Field of Search ..... 340/942, 907, 932.1, 340/908, 815.26, 555, 556; 250/222.1; 315/149, 154, 159; 362/35, 170; 318/16, 17; 40/531, 479, 473, 484, 493, 614, 430, 432, 431

[56] References Cited

U.S. PATENT DOCUMENTS

| | | | |
|---|---|---|---|
| 1,535,437 | 4/1925 | Overton | 40/473 |
| 1,932,441 | 10/1933 | Black et al. | 40/614 |
| 2,849,701 | 8/1958 | Clark | 340/942 |
| 2,870,559 | 1/1959 | Shaughnessy | 40/614 |
| 3,153,292 | 10/1964 | Glasgow | 40/479 |
| 3,896,414 | 7/1975 | Rulo | 340/942 |

FOREIGN PATENT DOCUMENTS

| | | | |
|---|---|---|---|
| 2137005 | 9/1984 | United Kingdom | 340/942 |

*Primary Examiner*—Jin F. Ng
*Assistant Examiner*—Dov Popovici
*Attorney, Agent, or Firm*—Leon Gilden

[57] ABSTRACT

An apparatus is arranged wherein a signal device is positioned in a confronting relationship for visual observation by a vehicle within a primary roadway adjacent to a secondary roadway, wherein the signal device is operative upon breaking of a photo-cell being directed orthogonally across the primary roadway adjacent a secondary roadway. The signal device is defined as a visual alert member and may optionally be formed to include a visual and audible device rotatably mounted for actuation upon breaking of a photo-cell signal directed across a secondary roadway relative to the primary roadway, wherein the visual signal is arranged to include alternating opaque and translucent faces to effect a flickering and enhanced visual alert to an operator of a vehicle in the primary roadway, as well as positioning of a signal device for observation by an operator of the device of the vehicle in a secondary roadway.

2 Claims, 4 Drawing Sheets

PRIOR ART

ROADWAY ALERT APPARATUS

BACKGROUND OF THE INVENTION

1. Field of the Invention

The field of invention relates to signal apparatus, and more particularly pertains to a new and improved roadway alert apparatus wherein the same effects alert of vehicles positioned where view is obstructed for alerting of a vehicle of an opposing vehicle's presence.

2. Description of the Prior Art

Various alert apparatus and signaling devices have been utilized in the prior art. Further, the use of photocell devices have been utilized in the prior art to alert operators of vehicles of relative vehicle positioning. Such apparatus may be found in U.S. Pat. No. 4,808,997 to Barkley, et al. wherein a photo-electric device is arranged for indication of positioning of a vehicle relative to a wall and the like upon the vehicle interposing a vehicle portion within a photo-cell signal.

U.S. Pat. No. 4,466,208 to Logan, Jr. et al. sets forth an emergency exit sign utilizing a brightness monitor with a photo-cell means for detecting an EL lamp combination with a pilot light.

U.S. Pat. No. 4,840,248 to Silverman sets forth a safety switch light fence for effecting signaling device to actuate when an object is sensed within a predetermined area.

U.S. Pat. No. 4,258,351 to Shigeta, et al. wherein a photo-cell organization is utilized in traffic intersection situations to monitor various signal devices as required.

U.S. Pat. No. 3,973,685 to Loomer presents a photoelectric sensing apparatus for pallet storage devices, where one sensor functions to sense the location of a stored pallet after a vehicle has been positioned under the stored pallet, as an example of utilizing photo-cells for vehicle positioning indication.

As such, it may be appreciated that there continues to be a need for a new and improved roadway alert apparatus as set forth by the instant invention which addresses both the problems of ease of use as well as effectiveness in construction and in this respect, the present invention substantially fulfills this need.

SUMMARY OF THE INVENTION

In veiw of the foregoing disadvantages inherent in the known types of roadway signal devices now present in the prior art, the present invention provides a roadway alert apparatus wherein the same utilizes photo-cell structure to effect actuation of a signal upon a vehicle in a secondary roadway breaking the signal for alert of a vehicle in a primary roadway and in a secondary roadway. As such, the general purpose of the present invention, which will be described subsequently in greater detail, is to provide a new and improved roadway alert apparatus which has all the advantages of the prior art roadway signaling devices and none of the disadvantages.

To attain this, the present invention provides an apparatus arranged for a signal device to be positioned in a confronting relationship for visual observation by a vehicle within a primary roadway adjacent to a secondary roadway, wherein the signal device is operative upon breaking of a photo-cell being directed orthogonally across the primary roadway adjacent a secondary roadway. The signal device is defined as a visual alert member and may optionally be formed to include a visual and audible device rotatably mounted for actuation upon breaking of a photo-cell signal directed across a secondary roadway relative to the primary roadway, wherein the visual signal is arranged to include alternating opaque and translucent faces to effect a flickering and enhanced visual alert to an operator of a vehicle in the primary roadway, as well as positioning of a signal device for observation by an operator of the device of the vehicle in a secondary roadway.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved roadway alert apparatus which has all the advantages of the prior art roadway signaling devices and none of the disadvantages.

It is another object of the present invention to provide a new and improved roadway alert apparatus which may be easily and efficiently manufactured and marketed.

It is a further object of the present invention to provide a new and improved roadway alert apparatus which is of a durable and reliable construction.

An even further object of the present invention is to provide a new and improved roadway alert apparatus which is susceptible of a low cost of manufacture with regard to both materials and labor, and which accordingly is then susceptible of low prices of sale to the consuming public, thereby making such roadway alert apparatus economically available to the buying public.

Still yet another object of the present invention is to provide a new and improved roadway alert apparatus which provides in the apparatuses and methods of the prior art some of the advantages thereof, while simultaneously overcoming some of the disadvantages normally associated therewith.

Still another object of the present invention is to provide a new and improved roadway alert apparatus wherein the same sets forth a visual and optionally audible signal upon a vehicle breaking a photo-cell beam for alert of the vehicle in a primary as well as secondary roadway intersection relationship.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above ill become apparent when consideration is given to the following detailed description thereof. Such description makes reference to the annexed drawings wherein.

DESCRIPTION OF THE PREFERRED EMBODIMENT

Figure 1:
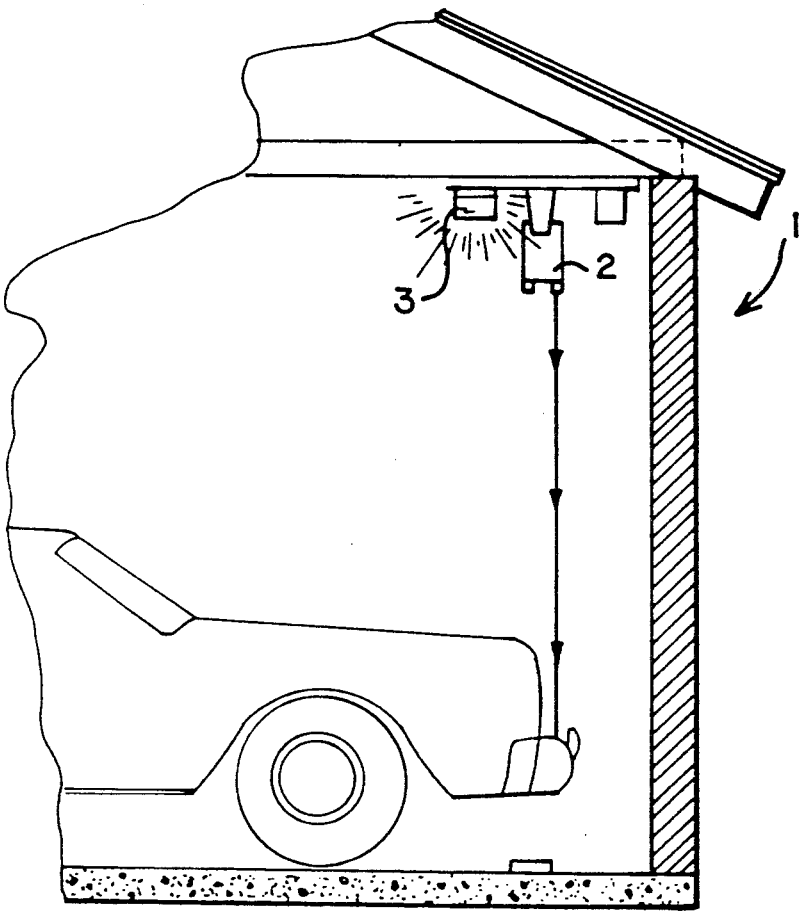
FIG. 1 is an orthographic view, partially in cross-section, of a prior art photo-cell signal device.

With reference now to the drawings, and in particular to FIGS. 1 to 7 thereof, a new and improved roadway alert apparatus embodying the principle and concepts of the present invention and generally designated by the reference numerals 10 will be described.

Figure 2:
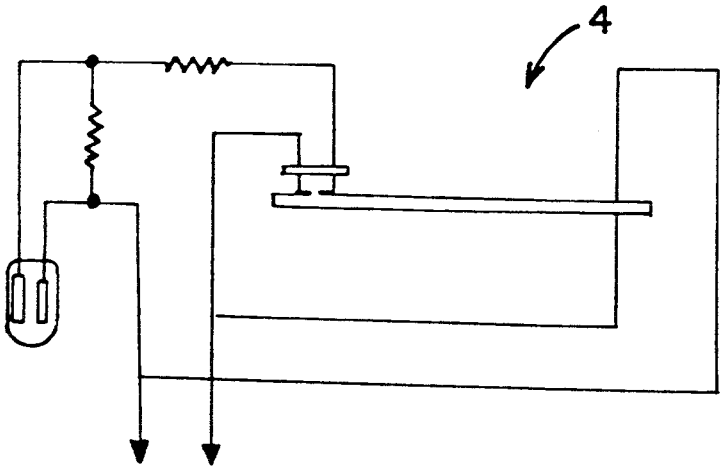
PRIOR ART Fig. 2
FIG. 2 is a diagrammatic illustration of a prior art photo-cell detector circuit.
Figure 3:
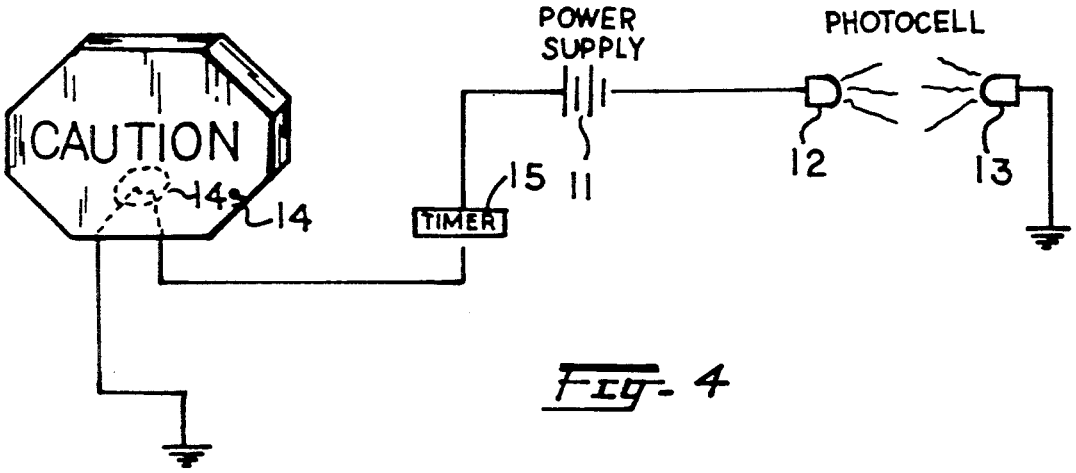
FIG. 3 is a diagrammatic illustration of circuitry utilized by the instant invention.

FIG. 1 illustrates a prior art alert apparatus 1, wherein a photo-cell device 2 effects actuation of a visual apparatus 3 upon the beam being broken by an associated vehicle, as illustrated and discussed in U.S. Pat. No. 4,808,997. FIG. 2 illustrates a circuitry 4 utilized in U.S. Pat. No. 4,466,208 for actuation of a signal device in cooperation with a photo-cell detector organization.

Figure 4:
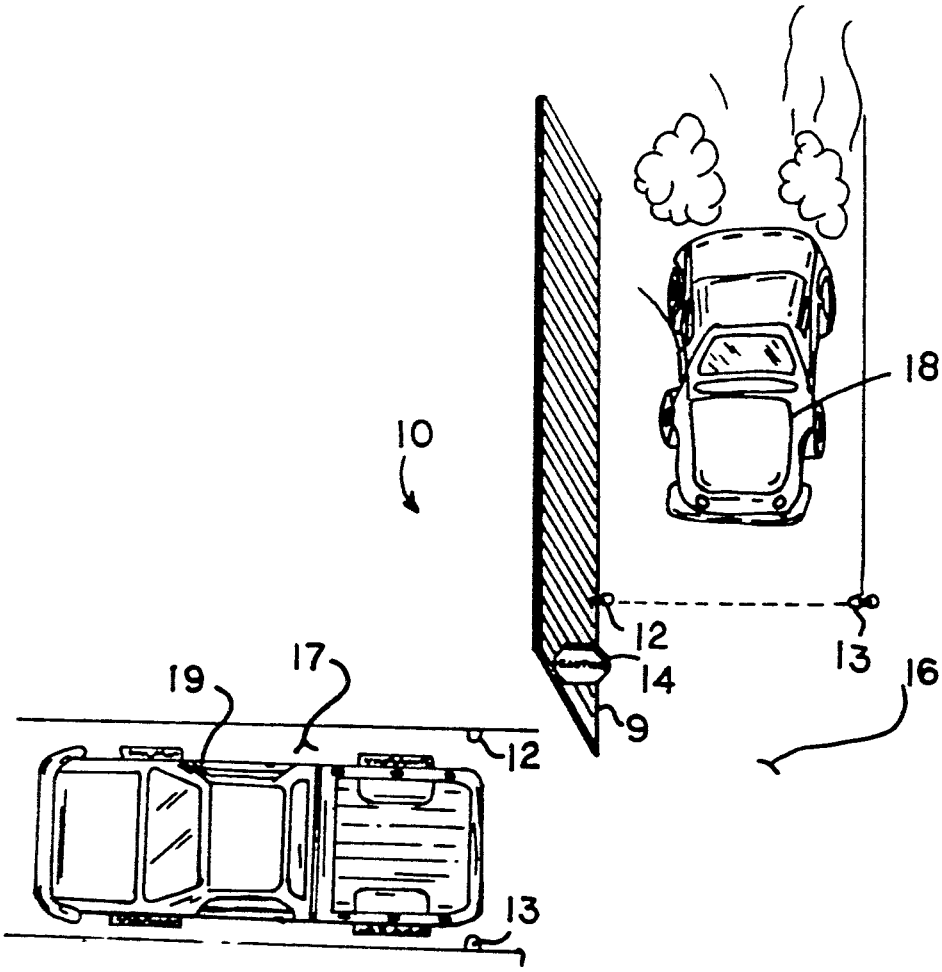
FIG. 4 is an isometric illustration of the instant invention arranged relative to an intersection of a primary and secondary roadway.

More specifically, the roadway alert apparatus 10 of the instant invention essentially comprises an electrical power supply 11 that may be in the form of a direct current storage battery, or conversely alternating current converted to a direct current electrical configuration, that includes in series a first photo-cell member 12 cooperative with a second photo-cell member 13 to define photo-electric communication between the first and second photo-cells. A signal device 14 includes an illunination member **14*a* therewithin that is operative through a timer mechanism 15, whereupon breakage of a beam defined within first and second photo-cell members 12 and 13 effect actuation of the signal member 14 for a predetermined time interval. Reference to FIG. 4 illustrates a primary roadway 16 intersecting a secondary roadway 17, with a first vehicle 18 traversing the primary roadway and a second vehicle 19 attempting access to the primary roadway 16. The second vehicle 19 interrupts a photo-cell beam between a first and second photo-cell 12 and 13 within the pathway of travel of the seond vehicle 19 to effect actuation of the signal device 14 mounted upon an associated support post 9. Further it is noted that a further first and second photo-cell member 12 and 13 may be directed across the pathway of the first vehicle 18 within the primary roadway 16 to also effect actuation of the signal device 14. It is noted that the signal device 14** is visually accessible by both the first and second vehicles to denote presence of an opposign vehicle to avoid collision between the two vehicles, as illustrated.

Figure 5:
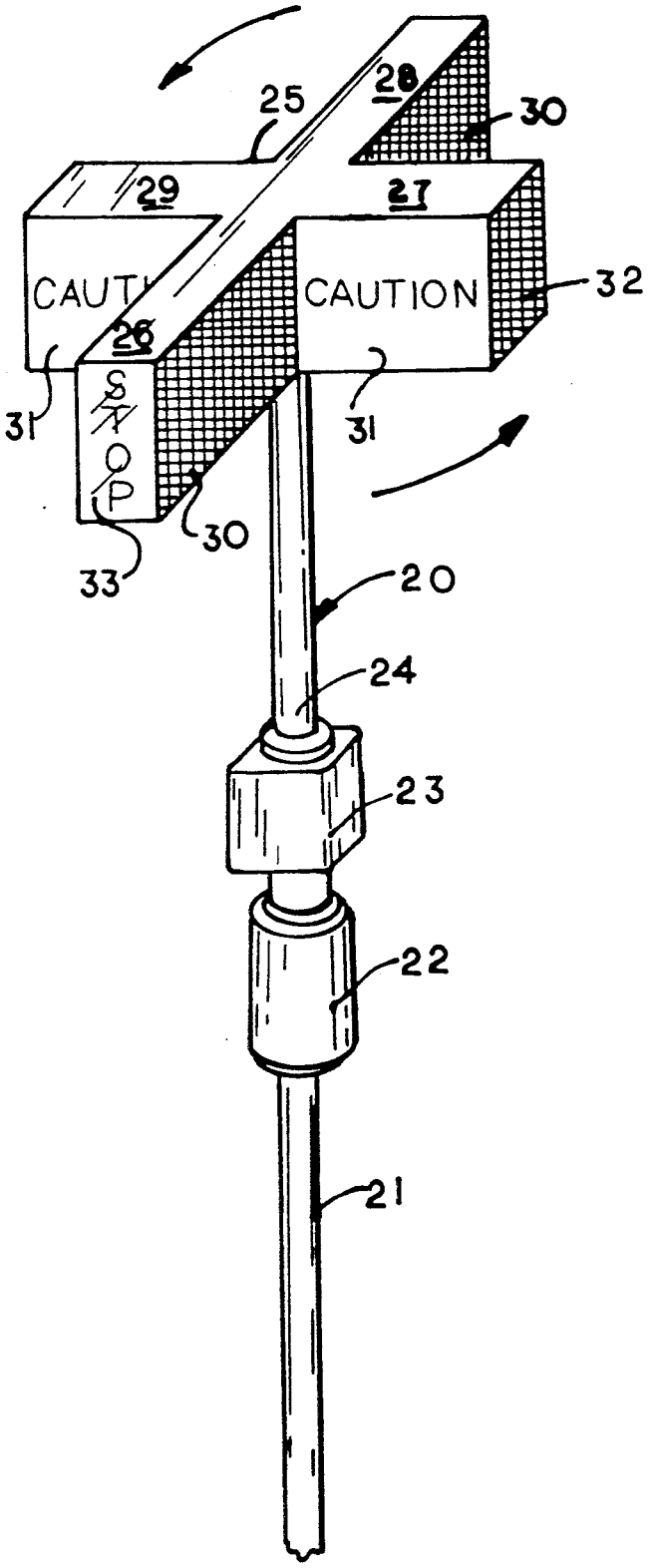
FIG. 5 is an isometric illustration of a modified signal device utilized by the instant invention.

A modified signal device 20, as illustrated in FIG. 5, is mounted upon a support shaft 21. The support shaft 21 coaxially mounts a drive motor 22 whose output is cooperative with a gear reduction assembly 23. The gear reduction assembly 23 includes a drive output shaft 24 that is rotatable upon actuation of the drive motor 22 upon a beam between a plurality of photo-cell members being interrupted, in a manner as discussed above. The drive output shaft 24 fixedly mounts a rotatable side member 25 thereon that is orthogonally mounted relative to the output shaft 24. The rotatable side member 25 is formed of a translucent material in a crucifix configuration defined by a respective first, second, third, and fourth body member 26, 27, 28, and 29 respectively. Each body member is defined of a generally parallelepiped configuration defining spaced parallel face plates and an end plate. Confronting first and second respectigve face plates defined by a first opaque face plate 30 and a second translucent face plate 31 of a plurality of confronting face plates of opposed and adjacent body members defines a pair of face plates. Each parir of face plates, due to the respective opaque and translucent nature of each face plate, effects a flickering of the illumination member **14*a*, such as mounted within the signal device 14, enhances visual observation of the sign during its rotation. Further, a respective first end plate 32 between spaced parallel translucent face plates 31 of body member 27 for example is opaque, wherein a second translucent end plate 33 is positioned between opaque first face plates 30, such as of the first body member 26. Alternating translucent and opaque configuration of each body member enhances the visibility of the modified signal device 20** as it is rotated.

Figure 6:
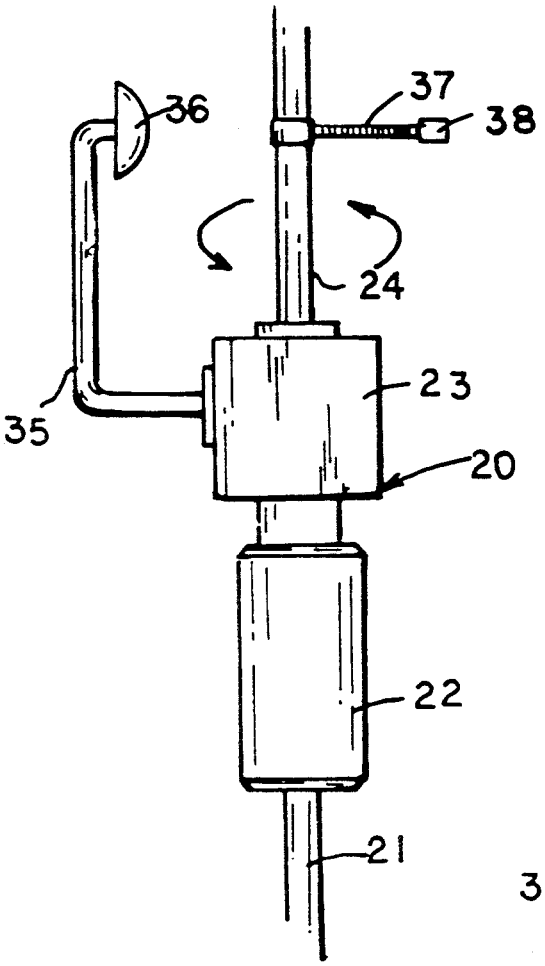
FIG. 6 is an orthographic side view, taken in elevation, of a further modified signal device portion utilized by the instant invention.
Figure 7:
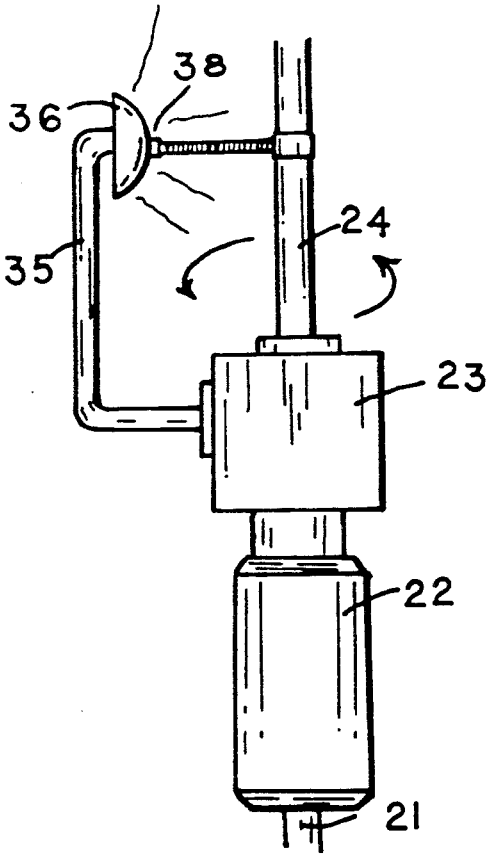
FIG. 7 is an orthographic side view, taken in elevation, of the signal device, as illustrated in FIG. 6 in an actuated orientation.

FIG. 6 illustrates the use of the modified signal device 20, including "L" shaped bracket 35 mounted to the gear reduction assembly 23 to position a bell member 36 in a spaced relationship relative to the drive output shaft 24. Orthogonally mounted to the drive output shaft is a linearly aligned spring arm 37 formed with a striker plug 38 at a forward terminal end thereof spaced from the drive output shaft 24. Upon rotation of the drive output shaft 24 in addition to the illumination of the sign member 25, an audible alarm is simultaneously effected by striking of the striker plug 38 against the bell member 36 during rotation of the drive output shaft 34.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the forgoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A roadway alert apparatus comprising, a first photo-cell member cooperative with a second photo-cell member to define a photo-cell beam therebetween, and an electrical power supply in electrical communication with the first photo-cell member, and a signal device in electrical communication with the power supply and the first photo-cell member, and an illumination member mounted within the signal device to effect illumination of the signal device upon disruption of the photo-cell beam, and the signal device includes an elongate support shaft, and a drive motor coaxially mounted to an upper terminal end of the support shaft, and a gear reduction assembly mounted coaxially with an in operative communication with said drive motor, and a drive output shaft coaxially directed from said gear direction assembly in coaxial alignment with the support shaft, and a sign member orthogonally and fixedly mounted to an upper terminal end of the drive output shaft, and the sign member is formed of a crucifix configuration, including a first, second, third, and fourth body member, with each body member orthogonally oriented relative to an adjacent body member, and each body member cooperates with the adjacent body member to define a pair of confronting face plates, wherein the face plates are defined by a respective first opaque face plate and a second translucent face plate mounted upon a respective body member and adjacent body member to define the pair of face plates, and each body member is formed of a parallelepiped configuration and includes an end plate orthogonally oriented relative to the face plates of each respective body member, and wherein the first and third body members include a translucent end plate, and the second and fourth body members include an opaque end plate, and wherein the gear reduction assembly includes an "L" shaped bracket mounted thereon, wherein the "L" shaped bracket includes a first leg oriented orthogonally relative to the drive output shaft, and a second leg extending parallel relative to the drive output shaft in a spaced relationship thereto, and the second leg includes a bell member mounted thereon wherein the bell member is spaced from the drive output shaft a predetermined spacing, and a linear spring arm mounted on the drive output shaft, said linear spring arm having a length substantially equal to the predetermined spacing, said linear spring arm includes a striker plug mounted on a free end thereof spaced from the drive output shaft by the predetermined spring, the linear spring arm is aligned with an positioned adjacent the bell member to effect impact between the striker plug and the bell member upon rotation of the drive output shaft, and the drive motor and the illumination members are in electrical communication with the power supply and the first photo-cell member to effect actuation of the drive motor and the illumination member upon destruction of the photo-cell beam by an object directed therebetween.

2. An apparatus as set forth in claim 1 including a primary roadway and a secondary roadway, wherein the primary and secondary roadways intersect at a defined intersection, and the support shaft is mounted adjacent the intersection of the primary and secondary roadways.

* * * * *